United States Patent [19]

Backe et al.

[11] Patent Number: 4,503,674

[45] Date of Patent: Mar. 12, 1985

[54] HYDROSTATIC DRIVE SYSTEMS

[75] Inventors: Wolfgang Backe, Aachen; Franz Weingarten, Frechen; Hubertus Murrenhoff, Aachen, all of Fed. Rep. of Germany

[73] Assignee: Linde Aktiengesellschaft, Wiesbaden, Fed. Rep. of Germany

[21] Appl. No.: 404,509

[22] Filed: Aug. 2, 1982

[30] Foreign Application Priority Data

Aug. 3, 1981 [DE] Fed. Rep. of Germany ..... 3130658

[51] Int. Cl.[3] ..... F16D 33/02

[52] U.S. Cl. ..... 60/448; 60/450; 60/451

[58] Field of Search ..... 60/403, 448, 449, 450, 60/451; 91/452, 451; 137/498, 503

[56] References Cited

U.S. PATENT DOCUMENTS 3,650,108 3/1972 Isaac ..... 60/450

4,195,479 4/1980 Dezelan ..... 60/420

*Primary Examiner*—Robert E. Garrett

*Assistant Examiner*—John M. Husar

*Attorney, Agent, or Firm*—Buell, Ziesenheim, Beck & Alstadt

[57] ABSTRACT

A hydrostatic drive system is provided with an adjustable hydraulic motor operatively connected between a high pressure main line and a low pressure line and equipped with a control arrangement that influences the setting in an r.p.m.-dependent manner, the improvement comprising a safety means that limits the stream flowing through the hydraulic motor.

6 Claims, 5 Drawing Figures

HYDROSTATIC DRIVE SYSTEMS

Figure 1:
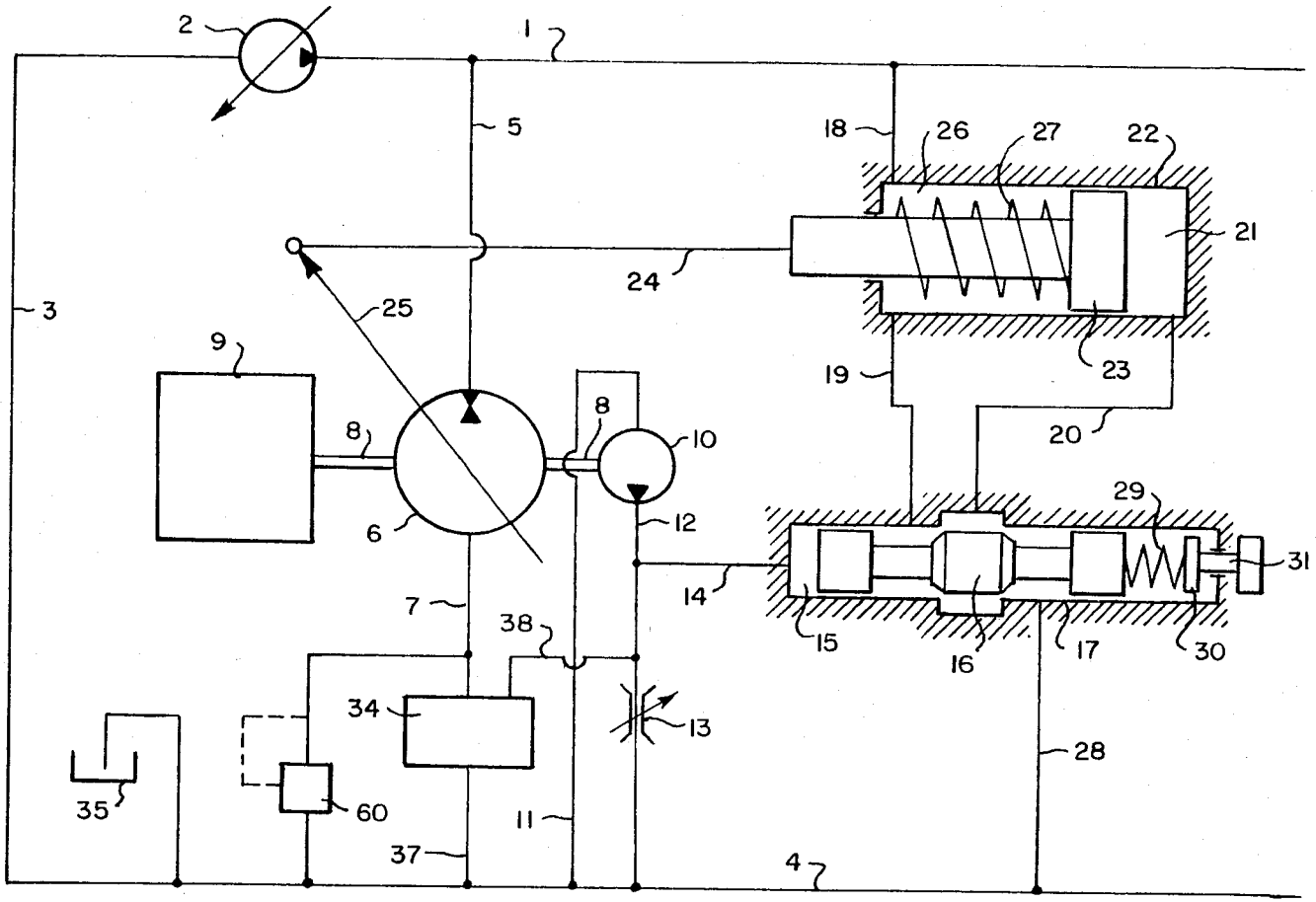

This invention relates to hydrostatic drive systems and particularly to a hydrostatic drive system with an adjustable hydraulic motor connected to a pressure main line fed with a high pressure maintained as constant as possible, in which line a stream unrestricted with respect to the consumer connected flows, and equipped with a control arrangement that influences the setting in an r.p.m.-dependent manner. Due to the fact that a practically unlimited stream can flow through the pressure main line to the hydraulic motor, there is the danger in such a drive system that the hydraulic motor may attain an inadmissibly high r.p.m. either because the hydraulic motor is suddenly sharply unloaded and the r.p.m. control arrangement cannot respond sufficiently rapidly or because a disturbance occurs in the r.p.m. control arrangement, e.g., a signal line is broken.

The invention proposes to avoid the danger of the hydraulic motor attaining an inadmissibly high r.p.m.

This problem is solved by installing a stream-restricting safety device in the line conveying the fluid stream to the hydraulic motor or in the line carrying the stream away from the hydraulic motor. This safety device can be a stream-limiting valve which throttles the stream and prevents it from exceeding the prescribed maximum value if the stream flowing through the hydraulic motor reaches a value above the maximum prescribed one. In the case of a motor set at a constant absorption volume it is sufficient to achieve a satisfactory margin of safety and it is also conditional in the case of an adjustable motor if the controlling arrangement of the motor is designed so that the motor is positively adjusted to a greater stroke volume per revolution in the case of any disturbance in the control arrangement because then it is assured that during any disturbance the highest possible volume stream flows through the motor at the maximum admissible r.p.m. and the safety device responds at this maximum volume stream. If on the other hand it is provided that with any disturbance in the control arrangement of the motor the latter is set at the minimum stroke volume per revolution—most likely in the zero-stroke position, the motor furnishes only a minimum torque during a disturbance and, provided the consumer is still connected to the shaft, the latter will drive with only a minimum torque. Because the r.p.m. is greater, the smaller the stroke volume per revolution in an adjustable motor with a given prescribed stream flowing through the motor, the setting must be considered if the motor is adjustable and should not exceed a definite maximum r.p.m., independently of the setting imposed on the motor. According to another advantageous embodiment of the object of invention, it is thus provided that the safety device is adjustable as a function of the setting of the hydraulic motor, such that the maximum stream to which the safety device is restricted, is a function of the motor setting. It can be taken into account here if a different maximum r.p.m. is admissible due to accelerations at large deviations than at small deviations, thus, a small volume per revolution.

If the setting of the hydraulic motor is determined by a specific control signal, it can be provided in an advantageous embodiment that the control signal determining or influencing the setting of the hydraulic motor also influences or determines the setting of the safety device.

Particularly advantageous embodiments of the safety device are indicated in claims 4 and 5.

Because the safety device is located in the main stream flowing through the hydraulic motor, it should have as low a flow resistance as possible since this resistance means energy loss in the principal working circuit. The safety device can be used in the same manner if the unit to which the safety device is assigned serves to regulate a piston capable of sliding in a cylinder.

The danger of attaining an inadmissibly high r.p.m. arises in a hydraulic motor adjustable by means of a regulating or control arrangement when the r.p.m. measuring arrangement is cut out of the circuit, e.g., because the connection between hydraulic motor and r.p.m. measuring arrangement is interrupted due to the breakdown of a component or due to a disturbance in the measuring arrangement itself or due to jamming of a control valve slide in a hydraulic control arrangement or due to disturbance in an additional mechanism designed to damp the control fluctuations. The valve comprising the safety device must shut off or at least throttle the line carrying the stream flowing through the hydraulic motor when an adjustable maximum admissible r.p.m. is exceeded and must restrict the stream flowing through the motor to a maximum admissible volume stream if the safety device no longer furnishes a clear signal on the setting imposed on the motor.

In the foregoing general description of this invention we have set out certain objects, purposes and advantages of the invention. Other objects, purposes and advantages will be apparent from a consideration of the following description and the accompanying drawings illustrating an implementation example of the invention in which:

FIG. 1 shows a circuit diagram for a drive system with a safety device according to the invention and FIGS. 2–5 show in cross section such a safety device in various operating states.

The hydraulic pump 2, which draws through line 3 from the low pressure line 4, which is connected to a pressureless tank 35, feeds into the pressure main line 1.

An inflow line 5 is connected to the pressure main line 1 and it leads to an adjustable hydraulic motor 6, to the shaft 8 of which a mechanical energy-absorbing consumer 9 is connected. The pressure medium flows from the hydraulic motor 6 through the drain line 7 to the safety device 34 and from there through the connecting line 37 to the low pressure line 4.

An auxiliary control pump is on the other hand connected to the shaft 8; it draws through a line 11 from the low pressure line 4 and delivers into a control pressure feed line 12 in which an adjustable restrictor 13 is located and which is also connected to the low pressure line 4 beyond this restrictor 13. A branch line 14 is connected to the control pressure feed line 12; it leads to the pressure chamber 15 of a control valve 17, in which a control piston 16 is capable of sliding against the force of a spring 29, which in turn rests against a spring plate 30, the position of which is adjustable by means of a threaded device 31 for modifying the pretension of spring 29. The control valve 17 is connected on the one hand through the system of lines 18, 19 to the pressure main line 1 and is on the other hand connected through line 28 to the low pressure line 4. The control line 20 connects the control valve 16 with the pressure chamber 21 in the controlling cylinder 22, in which a controlling piston 23 is capable of sliding. The piston rod 24 of piston 23 is connected with the controlling element 25 of hydraulic motor 6. On the side of controlling cylinder 22 with the piston rod and opposite the pressure chamber 21 a pressure chamber 26 is formed in cylinder 22. Pressure chamber 26 is connected through line 18 with the pressure main line 1 and a spring 27 is contained in it.

A control pressure line 38, which leads to the safety device 34, is connected to the control pressure feed line 12 in front of the restrictor 13 also.

The mode of operation is as follows: if a specific width of the restrictor is arbitrarily set at the restrictor 13 as a set point for the r.p.m., a specific pressure builds up at a given r.p.m. of the hydraulic motor 6 and thus of the auxiliary control pump 10 in front of the restrictor 13; it acts in the pressure chamber 15 on the face (on the left in the drawing) of control piston 16 and generates a force there that works against the force of spring 29. If these two forces are identical, the control piston 16 is in the closed position. If the force generated by the pressure in pressure chamber 15 is greater than the force of spring 29, the control piston is displaced to the right in the drawing and connects line 19 with line 20, such that pressure medium streams out of the pressure main line 1 through line 18 and pressure chamber 26 and lines 19 and 20 into the pressure chamber 21 and acts here on the larger face of controlling piston 23, which is thus shifted to the left in the drawing and moves the controlling element 25 of the hydraulic motor and adjusts the hydraulic motor 6 to a smaller stroke volume per revolution and thus a smaller torque, so that, considering that the consumer 9 absorbs a greater torque with increasing r.p.m., the r.p.m. drops. If the r.p.m. drops below the rated value or set point imposed by the setting of restrictor 13, the pressure in pressure chamber 15 correspondingly decreases and the force of spring 29 shifts the control piston 16 to the left in the drawing, such that the line 20 is connected with line 28 and pressure medium is released out of pressure chamber 21, so that the controlling piston 23 is shifted to the right in the drawing and the controlling element 25 of hydraulic motor 6 is adjusted to a greater stroke volume per revolution and thus a greater torque, so that the r.p.m. increases due to the greater torque. If the shaft 8 between the hydraulic motor 6 and the auxiliary control pump 10 breaks or the control pressure feed line becomes leaky between the auxiliary control pump 10 and the restrictor 13 or the branch line 14 becomes leaky, the pressure in pressure chamber 15 also drops and the force of spring 29 also displaces the control piston 16 to the left in the drawing, so that the pressure chamber 21 of controlling cylinder 22 becomes unloaded and the hydraulic motor is adjusted to a greater torque and thus a greater r.p.m. There is thus the danger that the hydraulic motor may be driven at an inadmissibly high r.p.m. A dangerous situation also arises if the shaft 8 breaks between the hydraulic motor 6 and the energy consumer 9 and the control arrangement cannot respond sufficiently rapidly or does not move at all due to the jamming of a piston. In these danger states the safety device 34 must limit the stream of pressure medium flowing out through the line 7.

A longitudinal borehole 39 is provided in the safety device 34. A groove 40 and a second groove 41 are provided in its wall and between them a section 42 with the normal diameter is formed. Line 7 is connected to groove 40 and line 37 is connected to groove 41.

A valve slide 43 is capable of sliding in the borehole 39. A pressure chamber is formed on each side of borehole 39 in front of the face of valve slide 43: pressure chamber 44 on the left side in the drawing and pressure chamber 45 on the right side in the drawing. A spring 46 is installed in pressure chamber 44 and spring 47 in pressure chamber 45. A travel stop 48 is also provided in pressure chamber 44 and a travel stop 49 in pressure chamber 45. Pressure chamber 45 is connected to the line 38.

The slide valve 43 has two end sections 50 and 51 that slide to close in the borehole 39 and it has a central sharply necked-down section 52.

Three boreholes are located in valve slide 43, of which borehole 53 empties at the periphery of end section 50 and also in its face. The second channel 54 empties in the same face and also at the periphery of end section 51 and the third channel 54 empties in the necked-down part around the constricted section 52 and also in the face assigned to the pressure chamber 45. A check valve 55 opening to pressure chamber 45 is located in this third channel 54.

Figure 2:
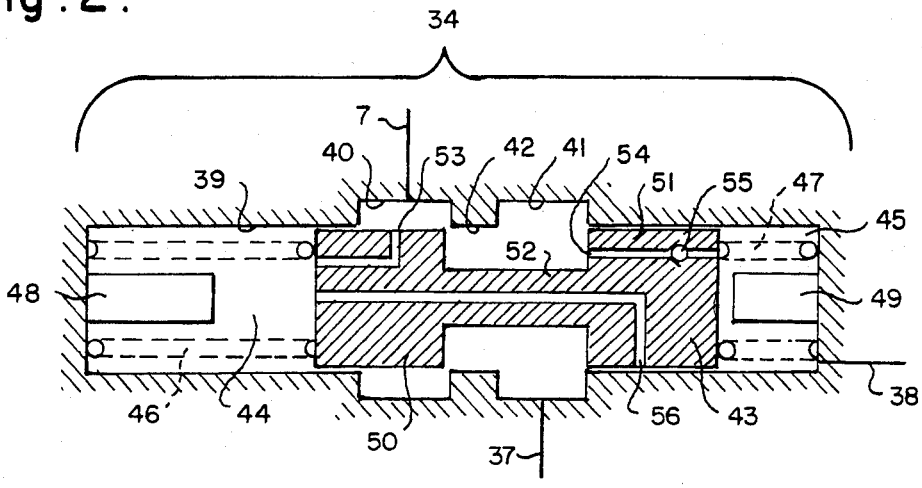

The safety device 34 in the position of the slide valve 43 assigned to stoppage is shown in FIG. 2. There is no pressure in the control pressure line 38 during stoppage. The position of slide valve 43 is determined by the equilibrium between the springs 46 and 47. Between the edge of end section 50 at the transition to the necked-down section 52 and the edge at the transition to the borehole section 42 a throttling action develops if a liquid stream flows through line 7 into the safety device 34 and through it to the connecting line 37 when the hydraulic motor is started up. A startup of hydraulic motor 6 is thus facilitated by the opening, though throttled, of this connection. However, the hydraulic motor 6 is to start only if the restrictor 13 is given a setting at which a pressure is built up in the control pressure feed line 12 that passes through line 38 into pressure chamber 45 and acts here on the face of end section 51 of the slide valve and displaces it to the left in the drawing against the force of spring 46. The slide valve 43 thus attains the position shown in FIG. 3 and frees a large open connection cross section between the drain line 7 and the connecting line 37. In this position the pressure gradient between lines 7 and 37 is minimal and the spring 46 is dimensioned so that if the hydraulic motor 6 has reached the r.p.m. that corresponds to the pressure in the control pressure feed line 12 and thus in the control pressure line 38, the valve slide 43 has reached the normal operating position shown in FIG. 3.

Figure 3:
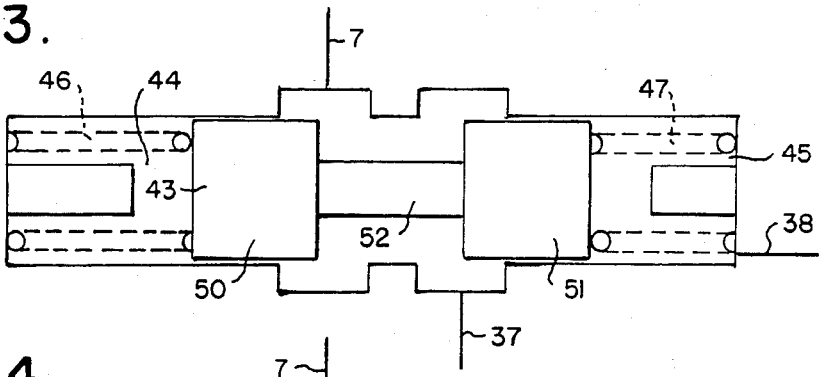
Figure 4:
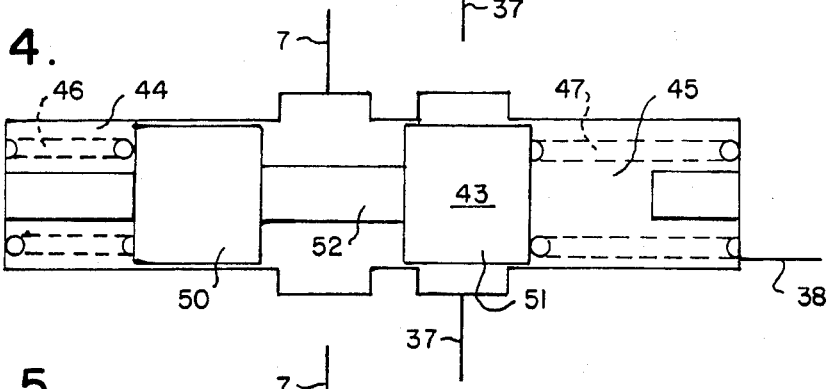
Figure 5:
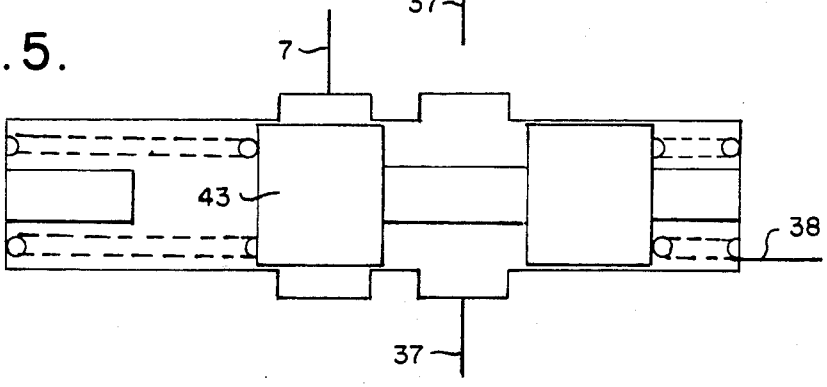

If the pressure retained in front of restrictor 13 rises as a result of excessive r.p.m. of the hydraulic motor 6 and thus the auxiliary control pump 10 rises to a greater value than provided, this pressure acts through the control pressure line 38 on the pressure chamber 45 and displaces the control slide valve 43 into the position shown in FIG. 4, in which the end section 51 of slide valve 43 closes off the borehole section 42 and thus interrupts the connection between the drain line 7 and the connecting line 37. Before this position is reached, in which a complete closure is achieved, the stream from the drain line 7 to the connecting line 37 is throttled. The pressure chamber 44 is connected in this position through the channel 56 with the groove 41 and thus through the connecting line 37 with the low pressure line 4, so that a pressure cannot build up due to oil leakage in the pressure chamber 44. If the connection between the drain line 7 and the connecting line 37 through the slide valve 43 as shown in FIG. 4 is completely interrupted, the strean through the hydraulic motor 6 and thus in it is blocked so that pressure can no longer develop in the control pressure feed line 12. The pressure in line 7 and thus in the groove 40 is however communicated through borehole 54 and the check valve (open in this case) to the pressure chamber 45 so that the slide valve remains in the position shown in FIG. 3, provided the pressure does not again flow out through line 38.

If a danger state arises due to the development of a leak in one of lines 12, 14, or 38, then the pressure in line 38 and thus in pressure chamber 45 drops and the valve first moves into the position shown in FIG. 2, in which the forces exerted by the springs 47 and 46 on the slide valve 43 are in equilibrium. The opening in the end section 51 of borehole 56 is closed off by the wall of borehole 39. However, if the hydraulic motor 6 continues to rotate, a stream flows through the drain line 7, which is throttled at the edge of groove 40 and is conveyed through the borehole 53 into the pressure chamber 44 so that a pressure is built up in the latter that exerts a force on the face of end section 50 of slide valve 43 which exceeds the force of spring 47 and shifts the slide valve 43 into the position shown in FIG. 5, in which the end section 50 closes the borehole section 42 and thus again prevents the liquid stream from flowing out from the drain line 7.

The springs 46 and 47 can be dimensioned so that if practically only they act on the slide valve 43, the throttling between the end section 50 and the edge of borehole section 42 is so sharp that the slide valve 43 is shifted into the closed position even at relatively small streams flowing through the drain line 7. This is particularly important if it is not assured that the hydraulic motor 6 is adjusted to the absorption volume at which the minimum torque results or is set to the zero stroke volume in the case of failure of the measuring equipment. Since the pressure in line 7 can rise up to the pressure in the pressure main line 1 if slide valve 43 completely shuts off the outflow, the safety device 43 is also held in the closed position by the pressure compensation through the channel 53 even in this closed position.

If the pressure can develop in the pressure main line 1 that is higher than the maximum admissible pressure in the drain line 7 or if it can be achieved by a torque from consumer 9 acting on the shaft 8 in the case of the prescribed pressure in the pressure main line 1 that the pressure in the drain line 7 is higher than the pressure in line 5 and thus exceeds a maximum admissible value, the attainment of an inadmissibly high pressure in the drain line 7 is prevented by the pressure-limiting valve 60.

In the foregoing specification we have set out certain preferred practices and embodiments of this invention, however, it will be understood that this invention may be otherwise embodied within the scope of the following claims.

We claim:

1. In a hydrostatic drive system with an adjustable hydraulic motor operatively connected between a high pressure main line and a low pressure line and equipped with a control arrangement that influences the setting in a r.p.m.-dependent manner, the improvement comprising a safety means in series between the motor and one of the high pressure line and the low pressure line that limits the stream flowing through the hydraulic motor, said safety means being adjustable and fluid pressure means acting on the safety means and motor whereby the setting of the safety means is a function of the setting of the hydraulic motor.

2. Drive system according to claim 1, in which the setting of the hydraulic motor is determined by a control signal, and the control signal also influences the setting of the safety device.

3. In a hydrostatic drive system with an adjustable hydraulic motor operatively connected between a high pressure main line and a low pressure line and equipped with a control arrangement that influences the setting in an r.p.m.-dependent manner, the improvement comprising a safety means that limits the stream flowing through the hydraulic motor, said safety device being a valve between the hydraulic motor and the low pressure line, said valve including a control pressure signal line connected to said valve, a slide member capable of sliding in a longitudinal borehole in said valve, two spaced annular grooves located in the wall of said borehole, one of which grooves is connected with a drain line from the hydraulic motor and the other with a line to the low pressure line, said slide valve having two end sections of full diameter and a central necked-down section around a portion of narrower diameter, whereby a pressure chamber is formed on both sides of the slide valve, a spring in each chamber normally urging the valve member generally centrally of the bore, one pressure chamber connected with a control pressure signal line, three passages formed in the slide valve, wherein a first passage connects one pressure chamber with the periphery of the end section of the slide member adjacent the connection with the motor drain line, a second passage connects said one pressure chamber to the periphery of the second end section and a third channel connects the necked-down section of the valve member with the other pressure chamber in the valve to which the control pressure signal line is connected.

4. Safety device according to claim 3, characterized in that a return check valve opening to the pressure chamber is located in the third passage.

5. Drive system according to claim 3, characterized in that the safety means is adjustable and the setting of the safety device is a function of the setting of the hydraulic motor.

6. Drive system according to claim 5, in which the setting of the hydraulic motor is determined by a control signal, and the control signal also influences the setting of the safety device.

* * * * *

UNITED STATES PATENT AND TRADEMARK OFFICE

CERTIFICATE OF CORRECTION

PATENT NO. : 4,503,674

DATED : March 12, 1985

INVENTOR(S) : WOLFGANG BACKE; FRANZ WEINGARTEN; HUBERTUS MURRENHOFF

It is certified that error appears in the above-identified patent and that said Letters Patent is hereby corrected as shown below:

Column 4, line 66, change "strean" to --stream--.

Column 5, line 37, change "43" to --34--.

Signed and Sealed this

*Seventeenth* Day of *September 1985*

[SEAL]

*Attest:*

*Attesting Officer*

DONALD J. QUIGG

*Commissioner of Patents and Trademarks—Designate*